US005775981A

United States Patent [19]

Yang

[11] Patent Number: 5,775,981

[45] Date of Patent: Jul. 7, 1998

[54] AIR DIE GRINDER

[76] Inventor: Maw-Chyuan Yang, No. 133, Chuan-Tou Lane, Ying-Pu Tsun, Ta-Tu Hsiang, Taichung Hsien, Taiwan

[21] Appl. No.: 815,608

[22] Filed: Mar. 12, 1997

[51] Int. Cl.[6] ..... B24B 47/14; B24B 23/02

[52] U.S. Cl. ..... 451/295; 451/358; 279/905

[58] Field of Search ..... 451/295, 344, 451/358, 359; 279/905

[56] References Cited

U.S. PATENT DOCUMENTS

| | | | |
|---|---|---|---|
| 4,107,949 | 8/1978 | Wanner et al. | 279/905 |
| 4,234,277 | 11/1980 | Benson et al. | 279/905 |
| 4,575,338 | 3/1986 | Maizenberg | 279/905 |
| 5,013,194 | 5/1991 | Wienhold | 279/905 |
| 5,398,946 | 3/1995 | Quiring | 279/905 |

FOREIGN PATENT DOCUMENTS

| | | | |
|---|---|---|---|
| 2621841 | 4/1989 | France | 279/905 |
| 2649028 | 1/1991 | France | 279/905 |
| 3730638 | 1/1989 | Germany | 279/905 |

*Primary Examiner*—Robert A. Rose

*Attorney, Agent, or Firm*—Morton J. Rosenberg; David I. Klein; Jun Y. Lee

[57] ABSTRACT

An air die grinder secured on a rotary shaft of a pneumatic motor by a fixing device is disclosed. The fixing device includes a sleeve having a driving section with none circular cross-section and a locating section with a circular cross-section. A ball hole is formed through the wall of the locating section of the sleeve. A steel ball is placed in the ball hole and pushed by an outer tube fitted around the sleeve to protrude out of the inner wall of the sleeve and abut against the stem of the grinding wheel, therefore the grinding wheel is located on the die grinder.

2 Claims, 5 Drawing Sheets

AIR DIE GRINDER

BACKGROUND OF THE INVENTION

The present invention relates to an air die grinder in which the grinding wheel with the stem can be easily and quickly assembled or disassembled without using any tool.

FIGS. 1 and 2 show a conventional air die grinder used as a pneumatic manually operated tool for polishing and grinding a die. The die grinder has a main body 1 as a hollow tube. A rear end 11 of the main body 1 is formed with an air inlet 12, while a front end 13 thereof is axially disposed with a pneumatic motor 14 which is located by a set of end caps 15. The rotary shaft 141 of the motor 14 axially extends out of the front end 13 of the main body 11. A hollow sleeve 16 is rotatably fitted on the rotary shaft 141. Two opposite plane sections 161 are formed on outer face of the sleeve 16. A claw-like cylindrical clamp 17 is fitted in the sleeve 16 and an outer sleeve 18 is screwed around the sleeve 16 to compress the cylindrical clamp 17 so as to clamp a stem 191 of a grinding wheel 19. The outer face of the outer sleeve 18 is also formed with two opposite plane sections 181, whereby a tool can be used to tighten the outer sleeve 18 to avoid axial detachment or rotation of the stem 191 of the grinding wheel 19.

The rotational speed of the air die grinder is at least over 18000 RPM. Under such high speed rotation, it is required that the axis of the grinding wheel 18 be coaxial with the axis of the rotary shaft 141. Even a tolerance is permitted, the allowed value thereof is only 0.03 mm. Otherwise, during the high speed rotation, the circumference 19 of the grinding wheel, which contacting with the work piece, will hit the work piece due to eccentricity. This often leads to crack of the work piece.

Although the above device is able to accurately secure the grinding wheel on the rotary shaft, some shortcomings still exist as follows:

1. The sleeve 16 is screwed on the rotary shaft 141 with the cylindrical clamp 17 gradually fastened by rotating the outer sleeve 18. Therefore, in actual operation, it is necessary to use two wrenches to respectively clamp the plane sections 161, 181 of the sleeve 16 and outer sleeve 18 and exert reverse force thereon so as to tighten or untighten the cylindrical clamp 17. Apparently, it is quite inconvenient to assemble or disassemble the grinder.

2. Since it is necessary to use two wrenches to assemble or disassemble the grinder, when selling the grinder, two wrenches are always enclosed therewith. In case any of the two wrenches is lost, it is difficult to immediately find another one with the same specification. This leads to inconvenience in operation.

3. The two wrenches must exert reverse rotational force onto the sleeves so as to clamp the stem of the grinding wheel, so that in case the stem is not precisely tightened due to negligence, the grinding wheel is quite apt to slip or evenfly out during operation.

4. With respect to the processing accuracy of concentricity, in addition to the rotary shaft 141, the following parts are also required: the screwing sections of the sleeve 16 and the rotary shaft 141, the fitting section of inner circumference of the sleeve 16 for the cylindrical clamp 17, the fitting section of the outer circumference of the cylindrical clamp 17 for the sleeve 16, the section of the inner circumference of the cylindrical clamp 17 for contacting with the stem 191 of the grinding wheel 19 and the section of the outer sleeve 18 for tightening the cylindrical clamp 17. Obviously, it is difficult to process these sections and the cost therefor is very high. A fast connector is used in some tools such as a pneumatic screwdriver or wrench. Such connector permits the screwdriver head to be quickly assembled with or disassembled from the tool without using any other tool. However, such tools are operated at low rotational speed and high accuracy of concentricity can be hardly required with respect to the screwdriver head and the power-outputting rotary shaft of the tool. Therefore, such connector is not applicable to the air die grinder.

SUMMARY OF THE INVENTION

In order to solve the above problems, it is a primary object of the present invention to provide an air die grinder in which when assemble or disassemble the grinding wheel with the stem, the assembly or disassembly can be quickly and easily achieved without using any tool. Moreover, after assembled, the grinding wheel with the stem can be precisely located on the axis of the rotary shaft.

It is a further object of the present invention to provide the above air die grinder in which the components can be quickly and easily processed at low cost.

The present invention can be best understood through the following description and accompanying drawings, wherein:

DETAILED DESCRIPTION OF THE PREFERRED EMBODIMENTS

Figure 1:
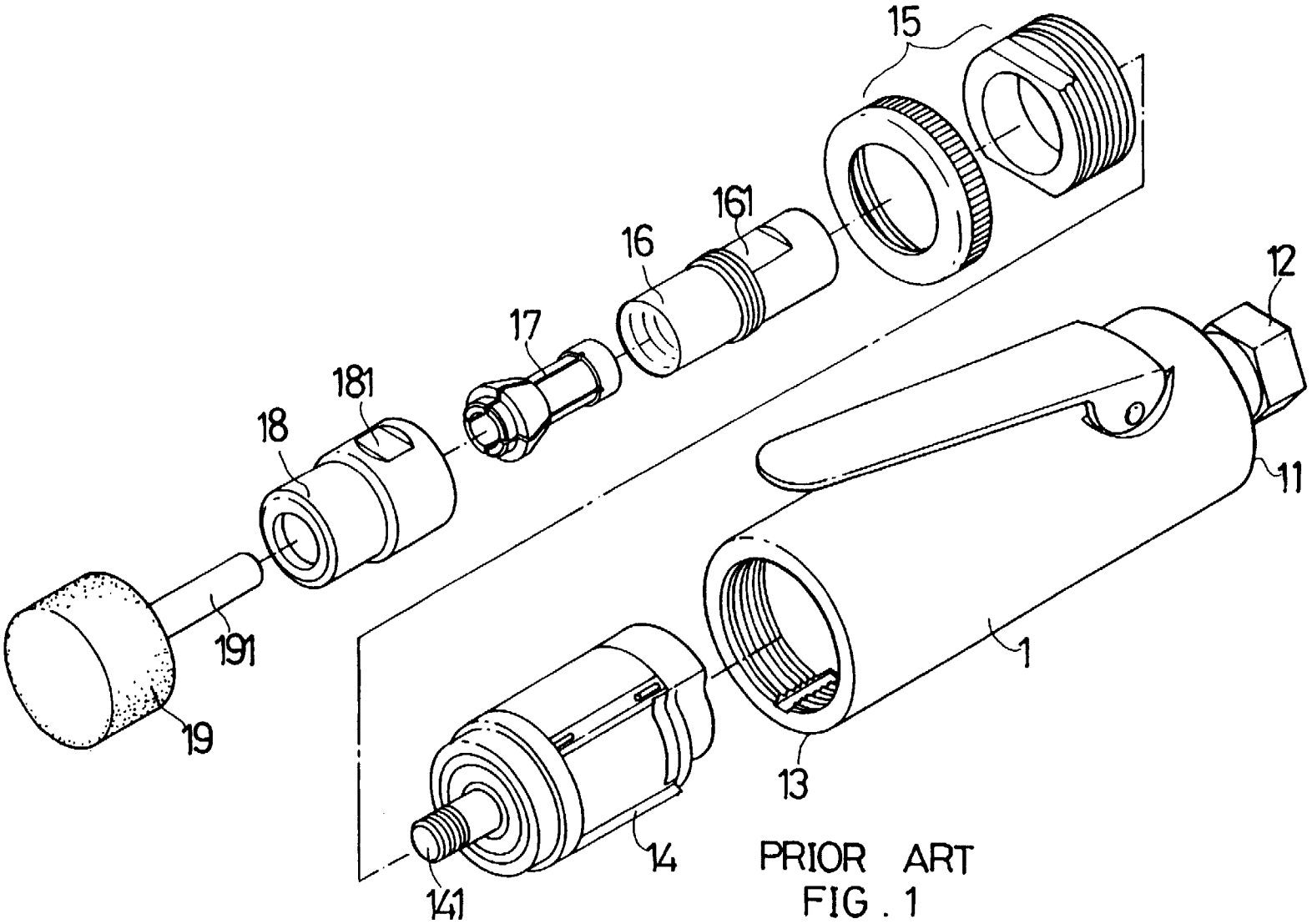
PRIOR ART FIG. 1
FIG. 1 is a perspective exploded view of a conventional air die grinder.
Figure 2:
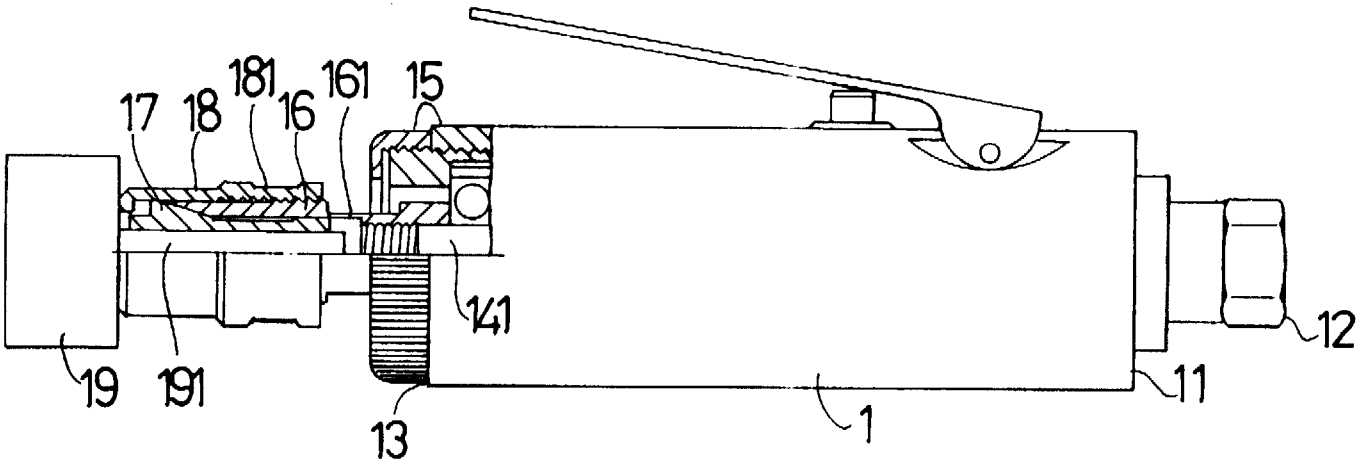
PRIOR ART FIG. 2
FIG. 2 is a side partially sectional view of the conventional air die grinder.
Figure 3:
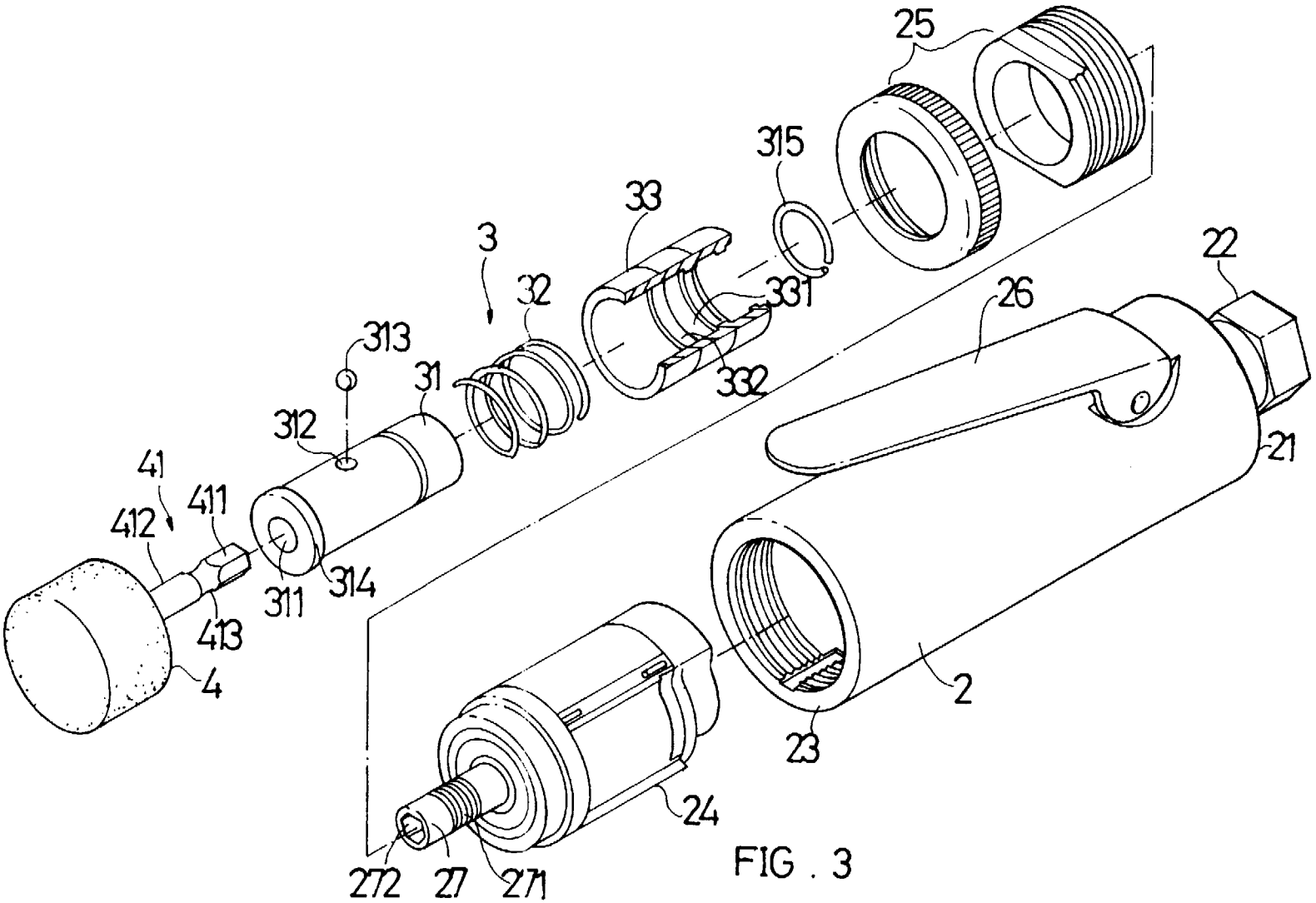
FIG. 3 is a perspective exploded view of a first embodiment of the present invention.
Figure 4:
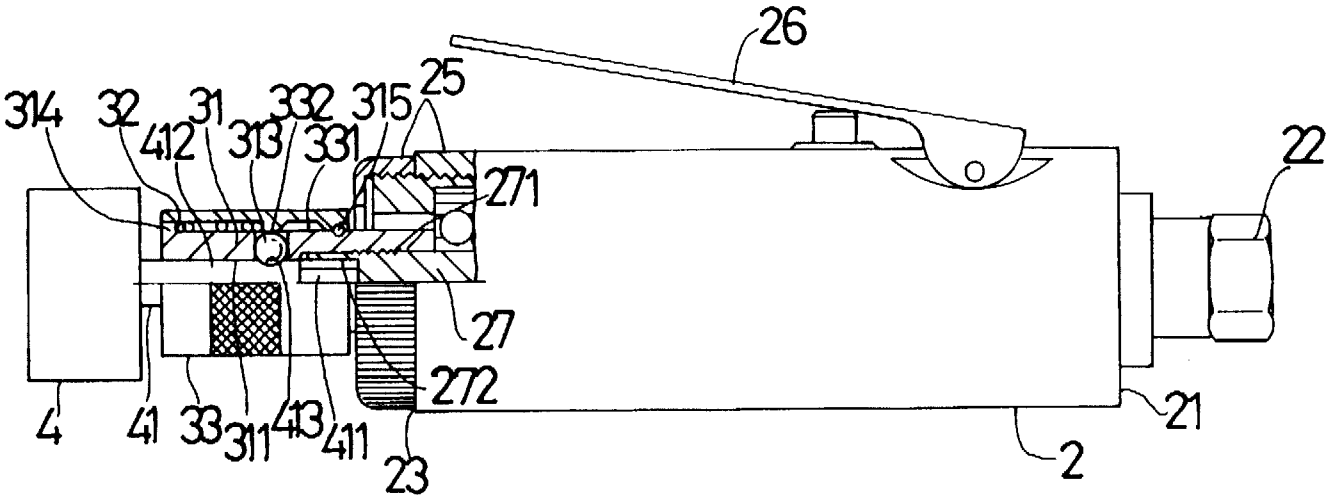
FIG. 4 is a side partially sectional view according to FIG. 3.

Please refer to FIGS. 3 and 4. The air die grinder of the present invention according to a first embodiment includes a main body 2 and a fixing device 3. The main body 2 is a hollow tube member. A rear end 21 of the main body 2 is formed with an air inlet 22, while a front end 23 thereof is axially disposed with a pneumatic motor 24 which is located by a set of front caps 25. The motor 24 is controlled by a switch 26. The rotary shaft 27 of the motor 24 axially extends out of the front end 23 of the main body 2. The outer face of the rotary shaft 27 is formed with a thread section 271.

The front end face of the rotary shaft 27 is formed with a rearward axially extending driving section 272 which is a cavity with a hexagonal cross-section.

The fixing device 3 includes a hollow sleeve 31 screwed on the thread section 271 of the rotary shaft 27. After the sleeve 31 is engaged with the rotary shaft 27, the hollow portion of the sleeve 31 forms a locating section 311 extending forward from the front end of the rotary shaft 27 along the inner wall of the sleeve 31.

The locating section 311 has a circular cross-section and has a length longer than that of the driving section 272. The diameter of the locating section 311 is larger than the distance between two diagonals of the driving section 272.

A ball hole 312 is formed through the wall of the locating section 311 of the sleeve 31. A steel ball 313 is placed in the ball hole 312. The diameter of inner end of the ball hole 312 is smaller than the diameter of the steel ball 313, whereby the steel ball 313 can protrudes out of the wall of the sleeve 31 without dropping out. The front end of the sleeve 31 is disposed with a large diameter flange 314. A stopper ring 315 is disposed between the ball hole 312 and the rear end of the sleeve 31 after a spring 32 and an outer tube 33 are fitted around the sleeve 31.

One end of the spring 32 abuts against the flange 314 of the sleeve 31, while the other end of the spring 32 abuts against the outer tube 33. An annular groove 331 is formed on inner wall of the outer tube 33 for the steel ball 313 to extend thereinto. Subject to the forcing of the spring 32, a pushing section 332 of the outer tube 33 free from the annular groove 331 pushes the steel ball 313 to protrude inward.

According to the above arrangement, after assembled, an air die grinder in which a grinding wheel with a stem can be quickly installed or detached is formed. In cooperation with the above structure, the stem 41 of the grinding wheel 4 is also modified. The stem 41 is formed with a driving section 411, a locating section 412 and a stopper section 413. The driving section 411 has a non-circular cross-section complementary to the driving section 272 of the die grinder. The locating section 412 is a rod member with a circular cross-section and has such a diameter that only a very small clearance exists between the rod member and the inner wall of the locating section 311 of the die grinder in which the locating section 412 is inserted.

The diameter of the locating section 412 is larger than the distance between the two diagonals of the driving section 411. The stopper section 413 is an annular groove between the locating section 412 and the driving section 411 for the steel ball 313 to insert therein.

In use, the outer tube 33 is first pushed forward with one hand, making the annular groove 331 aligned with the steel ball 313 and providing an outward moving space for the steel ball 313. At this time, the grinding wheel 4 is held with the other hand to axially insert the stem 41 into the front end of the sleeve 31 with the driving section 411 going into the driving section 272 of the rotary shaft 27 and with the stopper section 413 aligned with the steel ball 313. Then the outer tube 33 is released to be pushed rearward by the spring 32. At this time, the pushing section 332 of the outer tube 33 pushes the steel ball 313 to inward insert into the stopper section 413 of the stem 41 so as to complete the assembly of the grinding wheel 4.

The driving section 272 of the die grinder has a hexagonal cross-section and the driving section 411 of the stem 41 of the grinding wheel 4 also has a hexagonal cross-section so that when the driving section 411 is driven by the driving section 272, no idling or slippage will take place. In addition, the driving sections only serve to accomplish the driving function, so that it is unnecessary to have high cooperation accuracy therebetween.

The locating section 311 of the die grinder has a circular cross-section so that it is easy to achieve the requirement of processing accuracy. Accordingly, the locating section 311 is able to precisely cooperate with the locating section 412 of the grinding wheel 4, which also has a circular cross-section, with a very small clearance. Therefore, the grinding wheel 4 can be stably supported without swinging or eccentricity. As a result, an accurate locating effect as the conventional cylindrical clamp can be easily achieved.

The steel ball 313 is inserted into the stopper section 413 of the grinding wheel 4 so that the grinding wheel 4 is prevented from axially slipping. In addition, the steel ball 313 abuts against the stopper section 413 so as to reduce the vibration between the stem 41 of the grinding wheel 4 and the locating section 311 of the die grinder.

Figure 5:
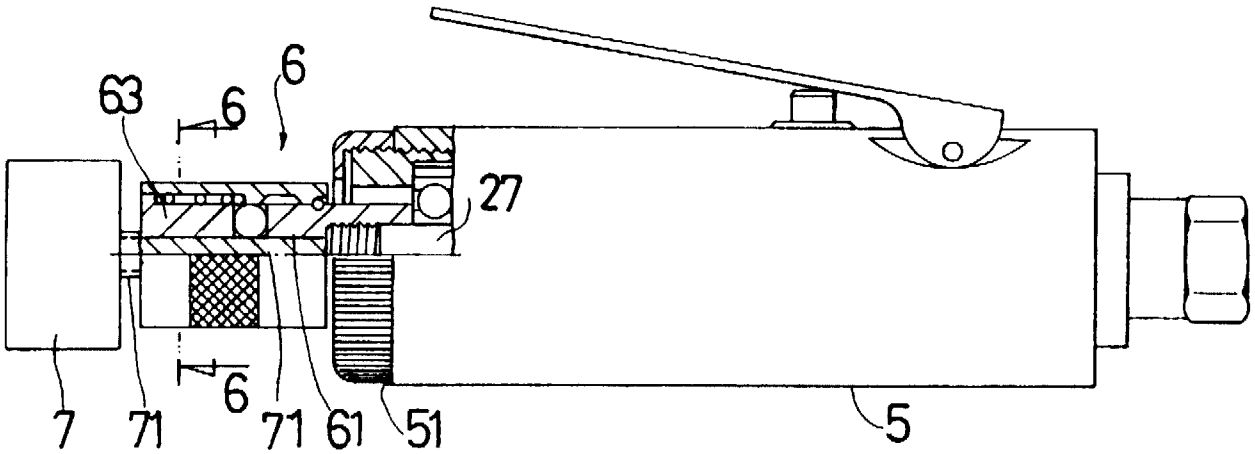
FIG. 5 is a perspective exploded view of a second embodiment of the present invention.
Figure 6:
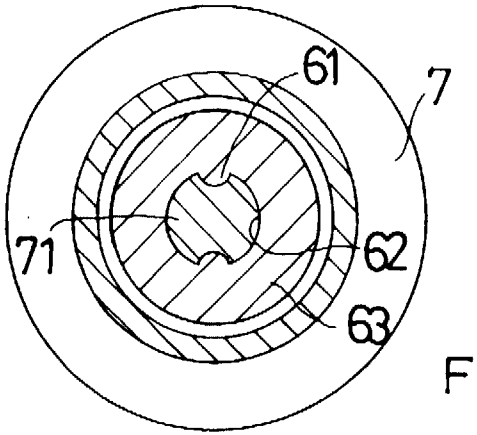
FIG. 6 is a sectional view taken along line 6—6 of FIG. 5.

FIGS. 5 and 6 show a second embodiment of the present invention, in which the driving section 61 and locating section 62 of the fixing device at the front end 51 of the main body 5 are the same socket forward extending from the inner wall of the sleeve 63. Also, the driving section 61 has a semicircular cross-section and projects inward from opposite side of inner face of the locating section 62. Certainly, the stem 71 of the grinding wheel 7 cooperating with the driving section 61 and the locating section 62 is formed with a profile complementary to the profile thereof.

It is to be understood that the above description and drawings are only used for illustrating some embodiments of the present invention, not intended to limit the scope thereof. Any variation and derivation from the above description and drawings should be included in the scope of the present invention.

What is claimed is:

1. An air die grinder comprising:

a main body formed by a hollow tube member, a rear end of the main body being formed with an air inlet, a front end of the main body being axially disposed with a pneumatic motor, a rotary shaft of the motor axially extending out of the front end of the main body; and, a fixing device secured on the rotary shaft, a stem of a grinding wheel being axially inserted and located in the fixing device, the fixing device including a hollow sleeve screwed on the rotary shaft, the hollow portion of the sleeve forming a driving section with a non-circular cross-section and a locating section with a circular cross-section extending forwardly from a front end of the rotary shaft, a wall of the locating section of the sleeve having a ball hole formed therethrough, the fixing device including a steel ball positioned in the ball hole, and an outer tube fitted around the sleeve and push the steel ball to protrude out of an inner surface of the wall of the locating section, the driving section of the fixing device having a groove extending rearwardly from the front end of the rotary shaft, the locating section being defined by a socket extending forwardly from the inner wall of the sleeve at the front end of the rotary shaft, the locating section having a length longer than that of the driving section.

2. An air die grinder comprising:

a main body formed by a hollow tube member, a rear end of the main body being formed with an air inlet, a front end of the main body being axially disposed with a pneumatic motor, a rotary shaft of the motor axially extending out of the front end of the main body; and, a fixing device secured on the rotary shaft, a stem of a grinding wheel being axially inserted and located in the fixing device, the fixing device including a hollow sleeve screwed on the rotary shaft, the hollow portion of the sleeve defining a socket forming a driving section with a non-circular cross-section and a co-located locating section extending forwardly from a front end of the rotary shaft, a wall of the socket of the sleeve having a ball hole formed therethrough, the fixing device including a steel ball positioned in the ball hole, and an outer tube fitted around the sleeve and push the steel ball to protrude out of an inner surface of the socket, the driving section including a portion of the socket protruding from the inner surface of the socket for engagement with a corresponding groove formed in the stem of the grinding wheel.

* * * * *